US007011215B2

(12) United States Patent
Meissen et al.

(10) Patent No.: US 7,011,215 B2
(45) Date of Patent: Mar. 14, 2006

(54) DISPLAY TRAY AND LID

(75) Inventors: Cynthia R. Meissen, Atlanta, GA (US); Kyle L. Baltz, Dallas, TX (US)

(73) Assignee: Rehrig Pacific Company, Los Angeles, CA (US)

( * ) Notice: Subject to any disclaimer, the term of this patent is extended or adjusted under 35 U.S.C. 154(b) by 19 days.

(21) Appl. No.: 10/465,323

(22) Filed: Jun. 19, 2003

(65) Prior Publication Data

US 2004/0256280 A1 Dec. 23, 2004

(51) Int. Cl.
*B65D 6/04* (2006.01)
*B65D 21/00* (2006.01)

(52) U.S. Cl. ..... 206/557; 206/511; 206/386; 220/DIG. 15; 220/659; 220/608; 229/5.5; D6/536

(58) Field of Classification Search ..... 206/511, 206/509, 508, 557, 821, 386, 516–519; 220/212, 220/916, 625, 783, 797, DIG. 15, 4.28, 23.6, 220/675, 604, 608, 657–659; 229/5.5; D6/536
See application file for complete search history.

(56) References Cited

U.S. PATENT DOCUMENTS 994,832 A * 6/1911 Hall ..... 249/168
D229,894 S * 1/1974 Reifers ..... D9/425
D237,363 S * 10/1975 Holden ..... D9/425
D247,025 S * 1/1978 Cherry ..... D9/424
4,550,830 A * 11/1985 Shuert ..... 206/386
5,109,985 A * 5/1992 Rose ..... 206/600
5,123,541 A * 6/1992 Giannini et al. ..... 206/600
5,133,460 A * 7/1992 Shuert ..... 206/600
D342,364 S * 12/1993 Hobson ..... D3/313
5,415,293 A * 5/1995 Ackermann et al. ..... 206/506
5,487,471 A * 1/1996 Marchek et al. ..... 206/725
D387,533 S * 12/1997 Noll et al. ..... D34/27
5,738,241 A * 4/1998 McEntee ..... 220/532
5,833,116 A * 11/1998 Guillin ..... 220/783
6,024,223 A * 2/2000 Ritter ..... 206/600
D460,651 S * 7/2002 Jobe et al. ..... D6/539

* cited by examiner

*Primary Examiner*—Jila M. Mohandesi

(57) ABSTRACT

A molded display tray and lid includes a generally planar base from which a pair of end walls and a pair of side walls extend generally perpendicularly. A downwardly extending lip extends about the periphery of the upper edge of the side walls and end walls. The side walls each include an upper edge that curves downwardly towards its center, such that the center of each side wall is the lowest point of the side wall. The base includes a plurality of integrally molded, downwardly extending feet. In use, the display tray and lid is first used as a lid on a box of produce, such as bananas. At its destination, the box and lid are inverted, and the box removed, such that the contents are left remaining on the display tray and lid.

26 Claims, 6 Drawing Sheets

DISPLAY TRAY AND LID

BACKGROUND OF THE INVENTION

The present invention relates generally to trays for displaying items such as produce and more particularly to a display tray that is also used as a box lid.

Currently, produce, such as bananas, is sometimes shipped in a cardboard box with a cardboard lid. The lid is simply a planar base with four side walls extending perpendicularly from the periphery of the base. When the produce arrives to at the grocer, it is either taken out of the box and placed on the stored shelves, or displayed in the box itself.

However, these options are not efficient. The box itself is not an ideal display tray for several reasons. First, water or fluid from the contents may damage the cardboard. The high side walls of the box also obscure some of the contents from potential customers. In addition, removing the produce from the box requires additional time and labor.

SUMMARY OF THE INVENTION

The present invention provides a display tray and lid that is more durable, reusable and that provides better display of the contents.

The display tray and lid includes a generally planar base from which a pair of end walls and a pair of side walls extend generally perpendicularly. The base, end walls and side walls are all integrally molded as a single piece of plastic. A downwardly extending lip extends about the periphery of the upper edge of the side walls and end walls. The side walls each include an upper edge that curves downwardly towards its center, such that the center of each side wall is the lowest point of the side wall. The base includes a plurality of integrally molded, downwardly extending feet.

In use, the display tray and lid is first used as a lid on a box (such as the previously-used cardboard box) of produce, such as bananas. At its destination, the box and lid are inverted and the box removed, such that the contents are left remaining on the display tray. The downwardly curved side walls improve the visibility of the produce in the display tray. The display tray and lid is durable and reusable.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
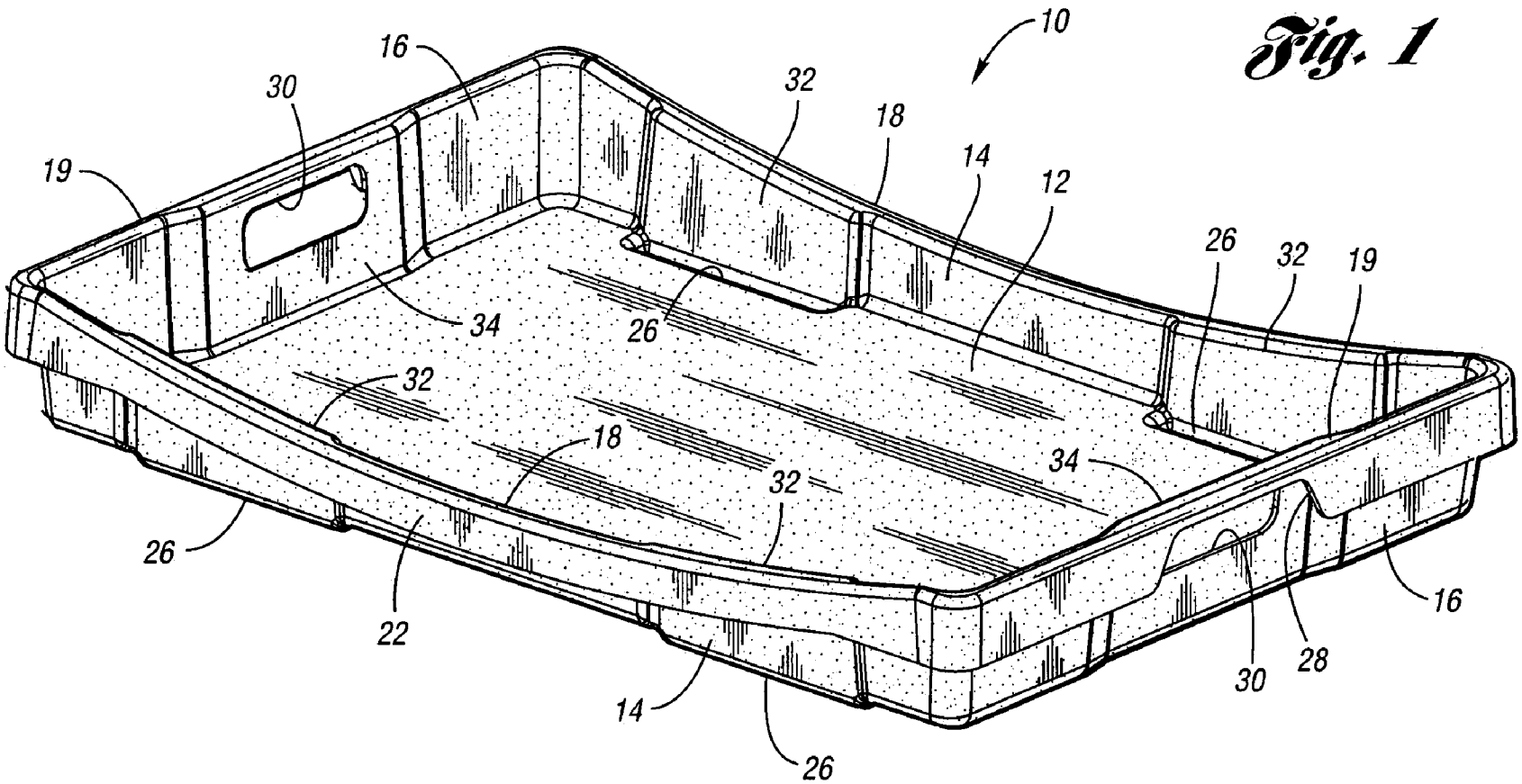
FIG. 1 is a top perspective view of a display tray and lid according to the present invention.
Figure 2:
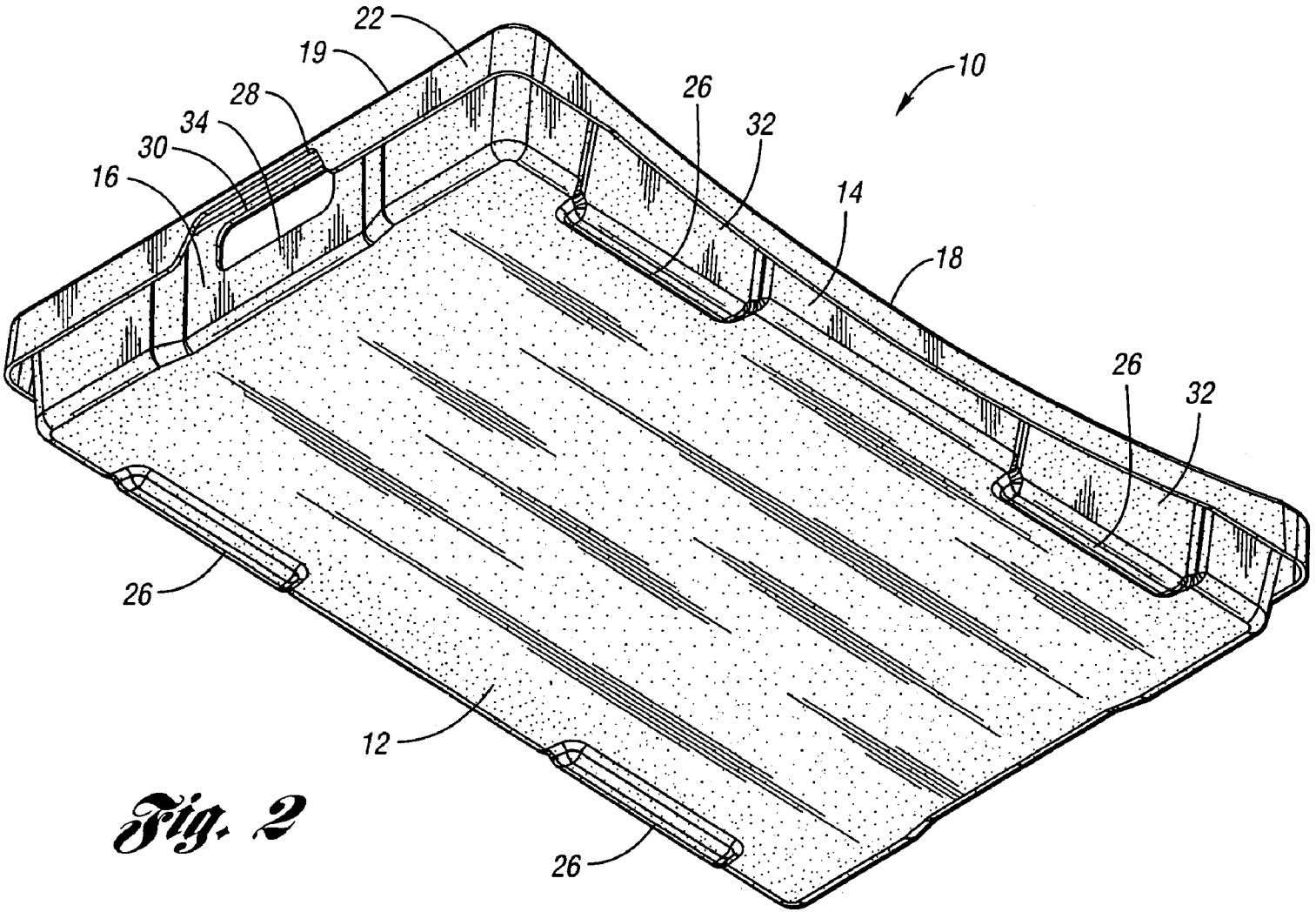
FIG. 2 is a bottom perspective view of the tray and lid of FIG. 1.

FIGS. 1–6 illustrate a display tray and lid 10 according to the present invention in its display tray orientation (opening upwardly). The display tray and lid 10 includes a generally planar base 12 from which generally perpendicular side walls 14 and end walls 16 extend. The side walls 14 and end walls 16 are angled slightly outwardly of the display tray and lid 10. The side walls 14 each include an upper edge 18 that curves downwardly toward the center of the sidewall 14, such that a center portion of the side wall 14 is shorter than end portions of the side wall 14 adjacent the end walls 16. A lip 22 extends outwardly and downwardly from the upper edges 18, 19 of the side walls 14 and end walls 16. The base 12 includes a plurality of elongated convex feet 26 protruding downwardly from the base 12. The feet 26 receive and provide clearance for the FBA tabs commonly found on produce boxes. Each of the end walls 16 includes a handle opening 30 that extends through a cutout portion 28 of the lip 22.

The display tray and lid 10 according to the present invention may be formed by any number of suitable manufacturing processes and materials, such as by a thermoforming process from ABS or polystyrene, or by injection molding from polypropylene.

Figure 3:
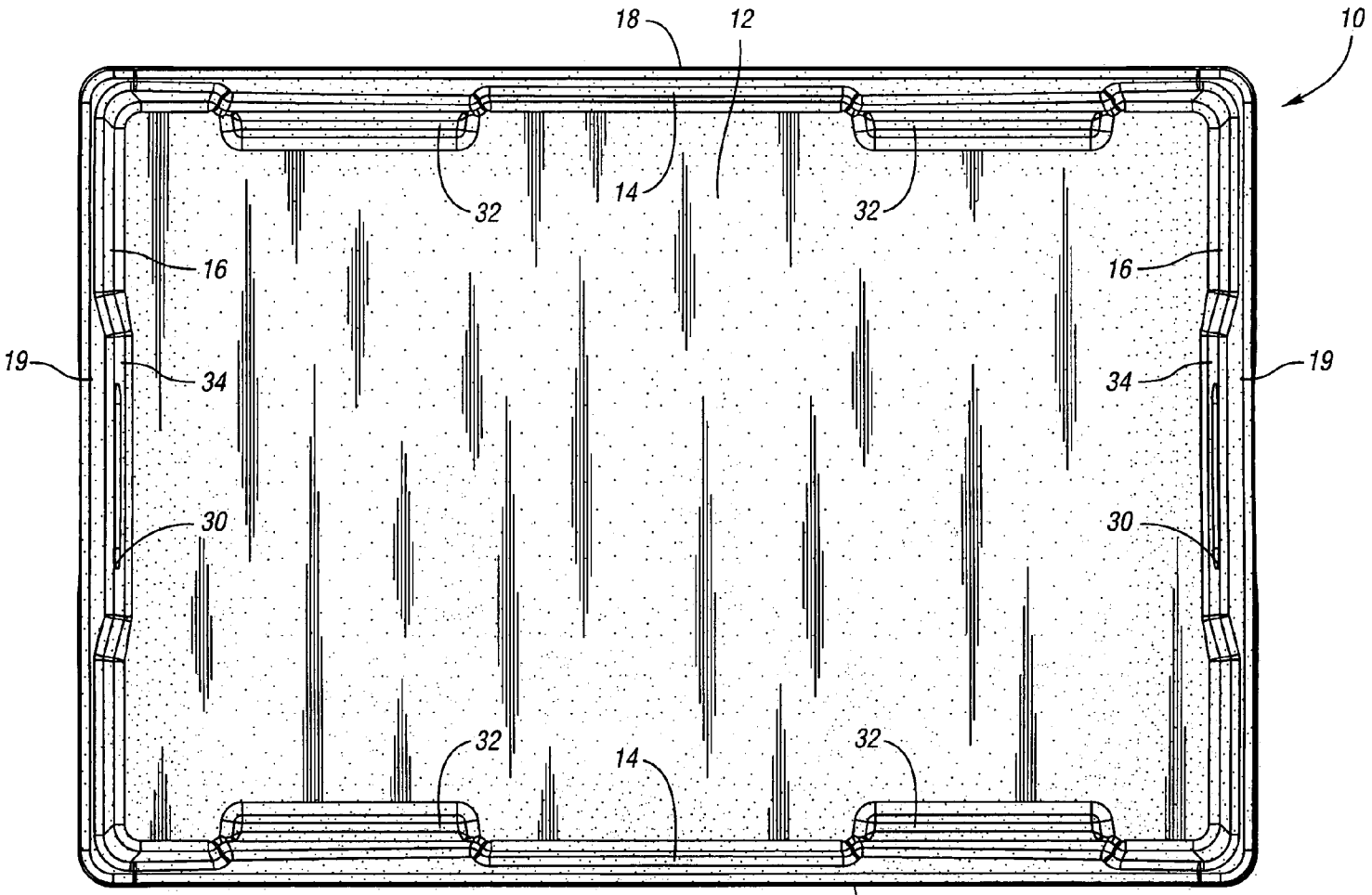
FIG. 3 is a top view of the display tray and lid of FIG. 1.
Figure 4:
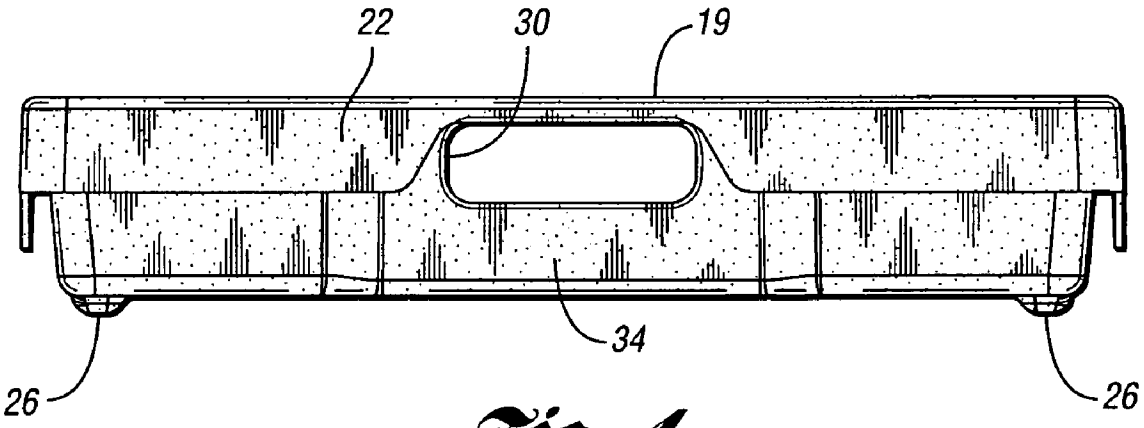
FIG. 4 is an end view of the display tray and lid of FIG. 1.
Figure 5:
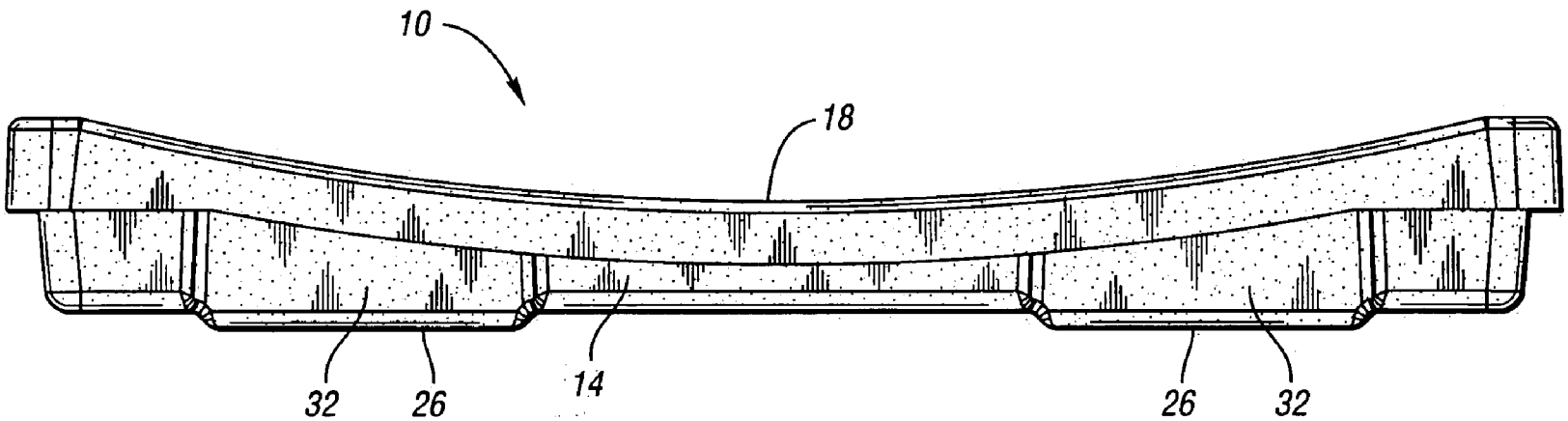
FIG. 5 is a side view of the display tray and lid of FIG. 1.
Figure 6:
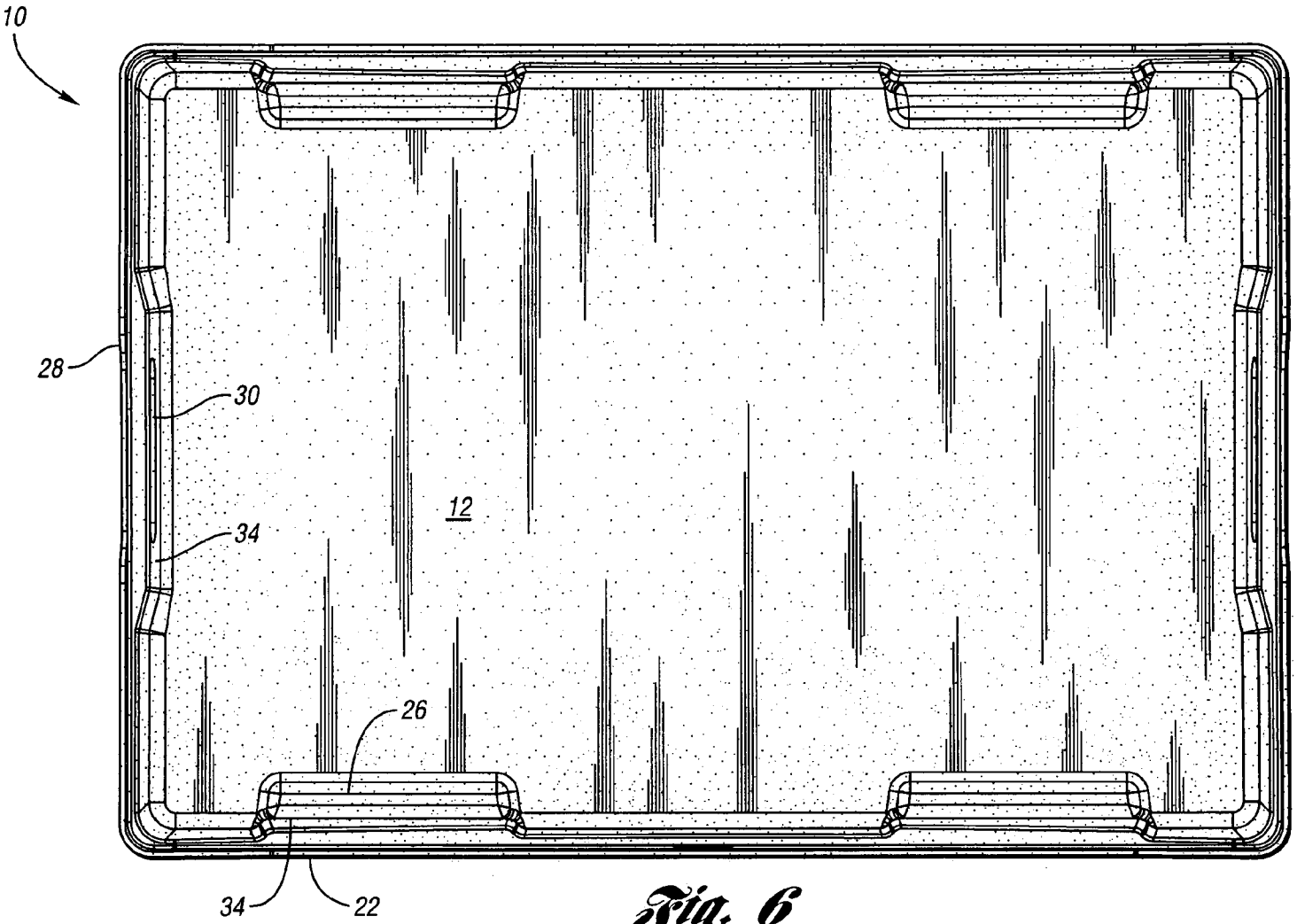
FIG. 6 is a bottom view of the display tray and lid of FIG. 1.

Referring to FIGS. 1 and 3, the side walls 14 and end walls 16 form a continuous wall about the outer periphery of the base 12. At each of the feet 26, the side wall 14 has a box-retaining portion 32 offset inwardly of the remainder of the side wall 14. At each handle 30, the end walls 16 each have a box-retaining portion 34 offset inwardly of the remainder of the end wall 16.

Figure 7:
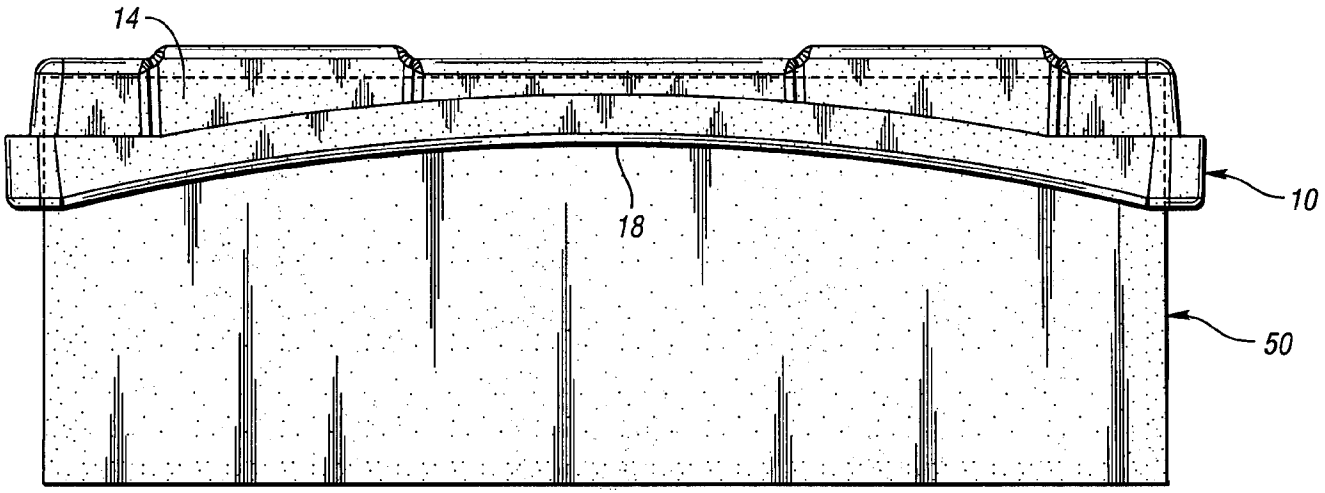
FIG. 7 is a side view of the display tray and lid of FIGS. 1–6 inverted and in use as a lid on a box, such as for produce.

In use, the display tray and lid 10 is inverted to its lid orientation as shown in FIG. 7 and placed over the opening of a generally rectangular box 50. The box 50 may be a common cardboard box, or it is also contemplated that it may be a plastic box, such as a plastic reusable produce container that is collapsible, and such box may contain any item or items, such as produce, including bananas. In the lid orientation as shown in FIG. 7, the display tray and lid 10 covers the opening of the box 50, protecting the contents of the box 50 and permitting multiple, like boxes 50 to be stacked upon one another. The box-retaining portions 32, 34 provide a snug fit on the box 50 and retain the display tray and lid 10 on the box 50.

Figure 8:
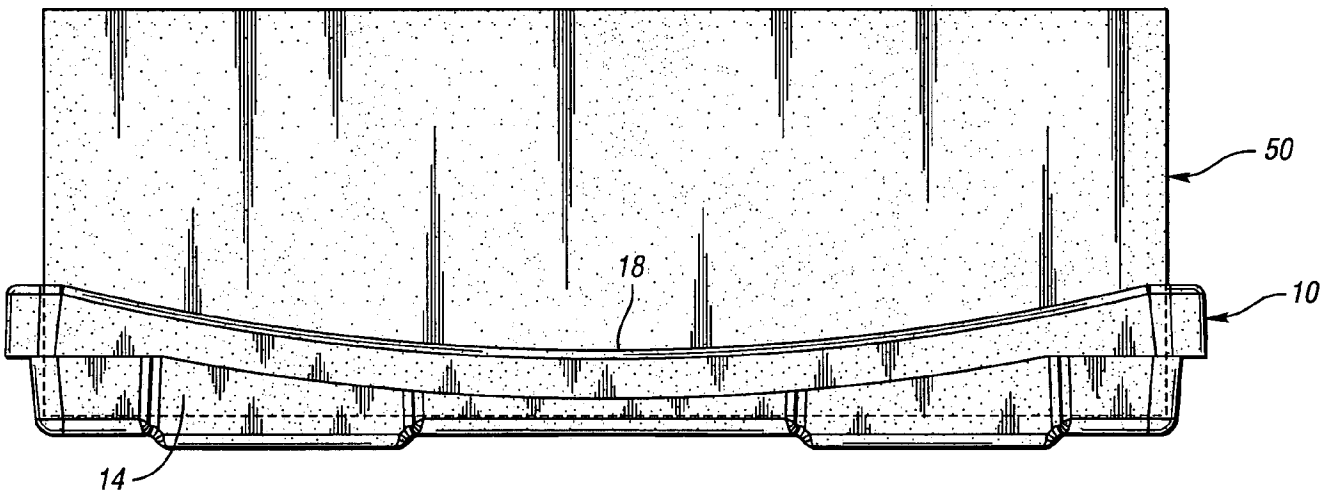
FIG. 8 is a side view of the display tray and lid and box of FIG. 7 in an inverted orientation.

In its most common use, the tray 10 is stored at the destination, such as a grocery store. When a box 50 arrives (with or without a standard shipping lid), the tray 10 is placed on box 50 as shown in FIG. 7, and are then inverted as shown in FIG. 8. The box 50 is then removed, such that the display tray and lid 10 is in the display tray orientation, as shown in FIGS. 1–6. In this orientation, the contents (not shown) overfill the display tray and lid 10 but are retained in the display tray and lid 10 by the side walls 14 and end walls 16. The downwardly curved upper edges 10 of the side walls 14 provide improved visibility of the contents. In this orientation, the contents can also be carried in the tray 10 using the handle openings 30 in end walls 16. The display tray and lid 10 is reusable and can be shipped back to the origination point for use on another box 50, but more commonly may be stored at the destination and reused continuously with new shipments of produce boxes. When empty, tray 10 is nestable within a like tray for efficient storage and transport.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A display tray and lid comprising:

a generally planar base;

a pair of generally parallel end walls extending generally perpendicularly to the base from opposite edges of the base;

a plurality of feet extending downwardly from the base; and a pair of generally parallel side walls both generally perpendicular to the end walls and extending generally perpendicularly to the base from opposite edges of the base, each side wall including a box-retaining portion protruding inwardly, the side walls each including an upper edge having a curved portion that is curved downwardly toward its center, each curved portion extending along a length of the upper edge of its respective side wall, the length greater than a distance between the feet proximate the respective side wall.

2. The display tray and lid of claim 1 wherein the base, end walls and side walls are all integrally molded as a single piece of plastic.

3. The display tray and lid of claim 1 wherein the plurality of feet are integrally-molded with the base and each foot includes a corresponding recess extending downward of an interior surface of the base.

4. The display tray and lid of claim 1 further including a handle opening through each of the pair of end walls.

5. The display tray and lid of claim 1 wherein each box-retaining portion is adjacent one of the plurality of feet protruding downwardly from the base.

6. The display tray and lid of claim 1 further including a lip extending outwardly and downwardly from an upper edge of the side walls and end walls.

7. The display tray and lid of claim 6 wherein the lip includes a lower free edge curving downwardly toward its center relative to a plane defined by the base.

8. A display tray and lid and box comprising:

a display tray and lid including a generally planar base and a pair of generally parallel end walls extending generally perpendicularly to the base from opposite edges of the base, a plurality of feet extending downwardly from the base; and the display tray and lid including a pair of generally parallel side walls both generally perpendicular to the end walls and extending generally perpendicularly to the base from opposite edges of the base, the side walls each including an upper edge having a curved portion that is curved downwardly toward its center, each curved portion extending along a length of the upper edge of its respective side wall, the length greater than a distance between the feet proximate the respective side wall, wherein the display tray and lid is on a box having two side walls and two end walls received between the side walls and end walls of the display tray and lid.

9. The display tray and lid and box of claim 8 wherein the box includes a base up from which the side walls and end walls extend, and wherein the box is inverted on top of the display tray and lid.

10. The display tray and lid and box of claim 8 wherein the base and walls of the display tray and lid are all integrally molded as a single piece of plastic.

11. The display tray and lid and box of claim 8 further including a plurality of integrally-molded feet extending downwardly from the base.

12. The display tray and lid and box of claim 8 further including a handle opening through the end walls.

13. The display tray and lid and box and box of claim 8 further including a lip extending outwardly and downwardly from the upper edge of the side walls.

14. A display tray and lid comprising:

a generally planar base;

a pair of generally parallel end walls extending generally perpendicularly to the base from opposite edges of the base;

a plurality of feet extending downwardly from the base; and a pair of generally parallel side walls both generally perpendicular to the end walls and extending generally perpendicularly to the base from opposite edges of the base, the side walls each including an upper edge having a curved portion that is curved downwardly toward its center, each curved portion extending along a length of the upper edge of its respective side wall, the length greater than a distance between the feet proximate the respective side wall, wherein at least one of the walls each includes at least one box-retaining portion protruding inwardly.

15. The display tray and lid of claim 14 wherein each of the box-retaining portions is offset inwardly from a remainder of the wall.

16. The display tray and lid of claim 15 on a box having four walls received between the walls of the display tray and lid.

17. The display tray and lid and box of claim 16 wherein the box is cardboard and is positioned on top of the display tray and lid.

18. The display tray and lid and box of claim 16 wherein the box is plastic and is positioned on top of the display tray and lid.

19. A box with a display tray/lid comprising:

a box having a generally planar base and four walls extending upwardly from a periphery of the base; and a plastic display tray/lid having a generally planar base and four walls extending downwardly from a periphery of the base, the four walls of the box received between the four walls of the display tray and lid, at least an opposing pair of the walls including a lower edge curved upwardly toward its center, the display tray/lid further including a plurality of integrally-molded feet extending upwardly from the base, wherein the plurality of feet each include a corresponding recess extending upward of an interior surface of the base of the display tray/lid.

20. The box with a display tray/lid of claim 19 further including a handle opening through an opposing pair of the walls.

21. The box with a display tray/lid of claim 20 wherein at least one of the walls each includes at least one box-retaining portion protruding inwardly.

22. The box with a display tray/lid of claim 21 wherein each of the box-retaining portions is offset inwardly from a remainder of the wall.

23. The box with a display tray/lid of claim 19 wherein the box is plastic and is positioned on top of the display tray and lid.

24. The box with a display tray/lid of claim 19 wherein the box is cardboard and is positioned on top of the display tray and lid

25. The box with a display tray/lid of claim 24 wherein base and the four walls of the box are cardboard.

26. A display tray and lid comprising a generally planar base:

a pair of generally parallel end walls extending generally perpendicularly to the base from opposite edges of the base;

a plurality of feet extending downwardly from the base; and a pair of generally parallel side walls both generally perpendicular to the end walls and extending generally perpendicularly to the base from opposite edges of the base, the side walls each including an upper edge having a curved portion that is curved downwardly toward its center, each curved portion extending along a length of the upper edge of its respective side wall, the length greater than a distance between the feet proximate the respective side wall, wherein the plurality of feet are integrally-molded with the base and each foot includes a corresponding recess extending downward of an interior surface of the base.

* * * * *